US005657870A

United States Patent [19]

Schöttle et al.

[11] Patent Number: 5,657,870

[45] Date of Patent: Aug. 19, 1997

[54] PACK FOR STACKED ARTICLES AND ADHESIVE STRIP THEREFOR

[75] Inventors: Klaus Schöttle, Strasbourg, France; Heinrich Wollensack, Kehl, Germany; Gerald-Wolfgang Borck, Ludwigshafen, Germany; Hans Dieter Erhardt, Renchen, Germany

[73] Assignee: BASF Magnetics GmbH, Mannheim, Germany

[21] Appl. No.: 515,975

[22] Filed: Aug. 16, 1995

[30] Foreign Application Priority Data

Aug. 20, 1994 [DE] Germany ..... 94 13 462.6 U

[51] Int. Cl.[6] ..... B65D 85/00; B65D 85/57

[52] U.S. Cl. ..... 206/459.5; 206/308.1; 206/460; 206/813; 235/487

[58] Field of Search ..... 206/459.5, 460, 206/444, 813, 308.1, 382.1; 229/120.01; 235/487

[56] References Cited

U.S. PATENT DOCUMENTS

| | | | |
|---|---|---|---|
| 2,159,227 | 5/1939 | Reufert et al. | 206/813 X |
| 2,517,801 | 8/1950 | Roush | 206/813 X |
| 2,554,791 | 5/1951 | Nickerson | 206/813 X |
| 2,703,764 | 3/1955 | Vogt | 206/460 X |
| 2,802,614 | 8/1957 | Gelin | 229/120.011 X |
| 4,669,611 | 6/1987 | Flaherty | 206/459.5 X |
| 4,709,399 | 11/1987 | Sanders | 206/813 X |
| 4,789,058 | 12/1988 | Blaney | 206/308.1 X |
| 4,821,487 | 4/1989 | James et al. . | |
| 4,827,114 | 5/1989 | Blachon | 235/487 |
| 4,850,488 | 7/1989 | Humbert | 206/459.5 |
| 4,928,817 | 5/1990 | Foche | 206/256 |
| 4,964,513 | 10/1990 | Ingram et al. | 206/459.5 |
| 5,180,055 | 1/1993 | Chance et al. | 206/256 |
| 5,360,107 | 11/1994 | Chesin et al. | 206/308.1 X |
| 5,366,791 | 11/1994 | Carr et al. | 206/529.2 X |
| 5,439,748 | 8/1995 | Nakamura et al. | 428/511 |
| 5,489,474 | 2/1996 | Shinoda et al. | 428/343 |
| 5,492,222 | 2/1996 | Weaver | 206/459.5 |

FOREIGN PATENT DOCUMENTS

| | | | |
|---|---|---|---|
| 8905045.2 | 4/1989 | Germany . | |
| 610682 | 10/1960 | Italy | 229/120.011 |
| 94/00362 | 1/1994 | WIPO . | |

*Primary Examiner*—Bryon P. Gehman
*Attorney, Agent, or Firm*—Keil & Weinkauf

[57] ABSTRACT

A pack for stacked articles with at least an identical base area, for example rectangular or square, comprises two adhesive strips which do not have lines of weakness or tearing lines and are provided at least on the narrow sides of the stack. The material is recyclable and corresponds as far as possible to the other packaging material. A gripping aid facilitates the largely non-destructive pulling off of the adhesive strips for individually separating the articles. The pack can be used for all rectangularly shaped articles such as cuboids, cubes, disks etc.

16 Claims, 5 Drawing Sheets

PACK FOR STACKED ARTICLES AND ADHESIVE STRIP THEREFOR

The invention relates to a pack for stacked individual articles which are provided with an individual marking each and have an approximately identical shape in at least one view, for example a rectangular or square shape, comprising at least one adhesive strip which joins at least the side faces of the stacked individual articles to one another, with parting joints in between, to form a transportable stack, and also to such an adhesive strip itself.

In DE-U 88 05 045, packs for identical articles of cuboid or cube form have been created with U-shaped pieces of adhesive tape. In the region of the parting joints, the pieces of adhesive tape were provided with tearing lines, formed in particular as perforations.

In DE-U 93 16 388 there is described a protective enveloping unit comprising a plurality of identically shaped stacked separate containers which are joined to one another by means of side or corner adhesive strips. Tearing lines are provided in the region of the parting joints.

In both known cases, it is not ensured that the stacks of articles will also remain together if they are dropped from a certain height into sales dump bins and that the predetermined breaking lines will not tear open prematurely and unintentionally, with the result that the packs are damaged.

It is an object of the present invention to avoid such disadvantages and improve in particular the identification of the individual and multiple packs for manufacture, storage and shipment.

We have found that this object is achieved by a pack of the type described at the beginning if the at least one adhesive strip is formed without lines of weakness or tearing lines along the parting joints of the stacked individual articles and at least partially covers at least one individual marking of the stacked individual articles.

Expediently, two adhesive strips may also be used. In both cases this produces a stable and simple pack, in which the requirements for identification are fully met in a material-saving way.

In a further refinement, the adhesive strip bears a marking of its own or a marking supplementing or altering the individual marking.

This makes it possible to identify the type of multiple pack, with or without an individual marking. In a further design, the adhesive strip is a paper adhesive strip, for example for cardboard outer packs such as video cassette cases.

The pack may advantageously consist of a recyclable plastics material.

If the individual packaging/the individual wrapping of the articles consists of a plastics film material, the adhesive strip may favorably consist of the same or at least a jointly recyclable material, for example of polyethylene film or polypropylene film.

For environmental reasons, the adhesive strip or strips may advantageously also consist of a material from the group consisting of caprolactone, cellulose acetate and polymeric starch derivative and also from the group consisting of monopolymers and copolymers of linear polyesters of 3-hydroxyvaleric acid.

The adhesive strips may be attached on a stack twice in an L shape or once in a U shape and once in a straight shape (I shape) or else once in a U shape and once in an L shape or twice in a U shape.

The adhesive strip may expediently have an end or edge region which is designed for grasping with the hand and on which the adhesive area is covered, which can be realized for example as a turned-over region or covering layer.

An adhesive strip for the pack according to the invention bears a marking for the stacked individual articles (the entire stack).

The adhesive strip is expediently provided with an adhesive which can be detached non-destructively from the individual pack. The pack can advantageously be used for any type of magnetic-tape cassettes, compact disks (CDs) and similar recording media, preferably in boxes.

Exemplary embodiments of the invention are represented in the drawing and described below.

In the drawing:

FIG. 1A-2 shows a side view of cuboidal articles with one adhesive strip

FIG. 2 shows a perspective view of the articles of FIG. 1A-1

Figures 1, 1A:
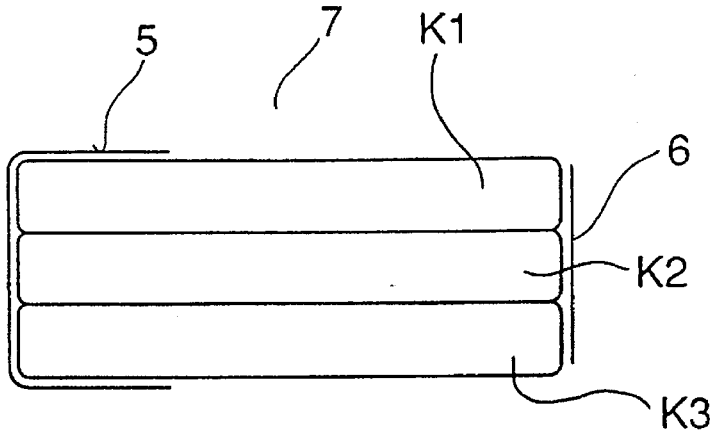
FIG. 1A-1 shows a side view of cuboidal articles with two adhesive strips
Figure 3:
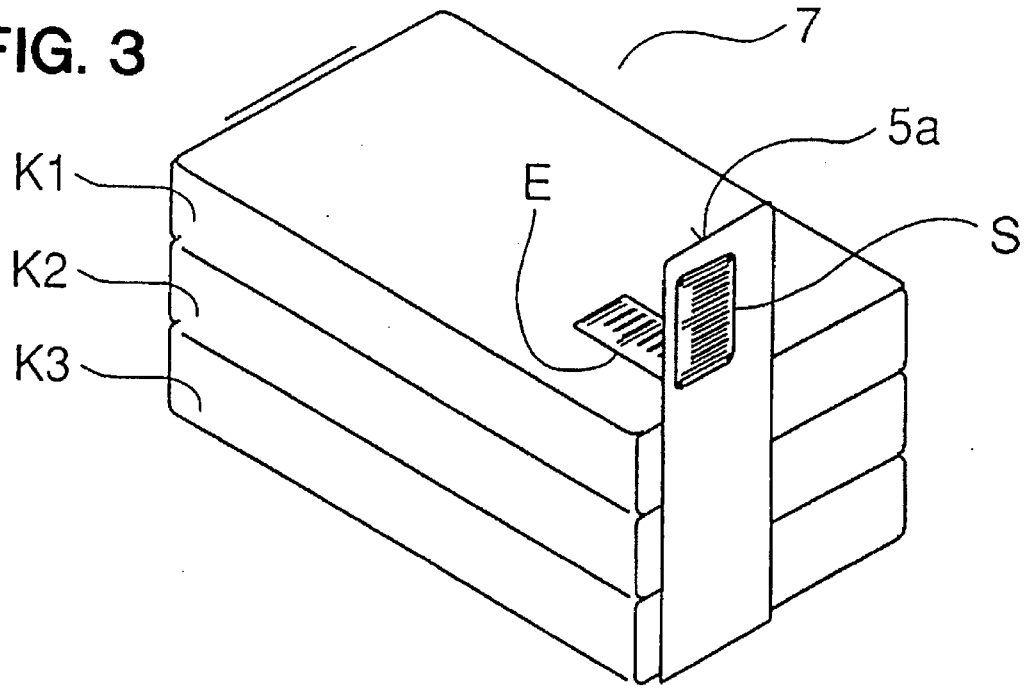
Figure 4:
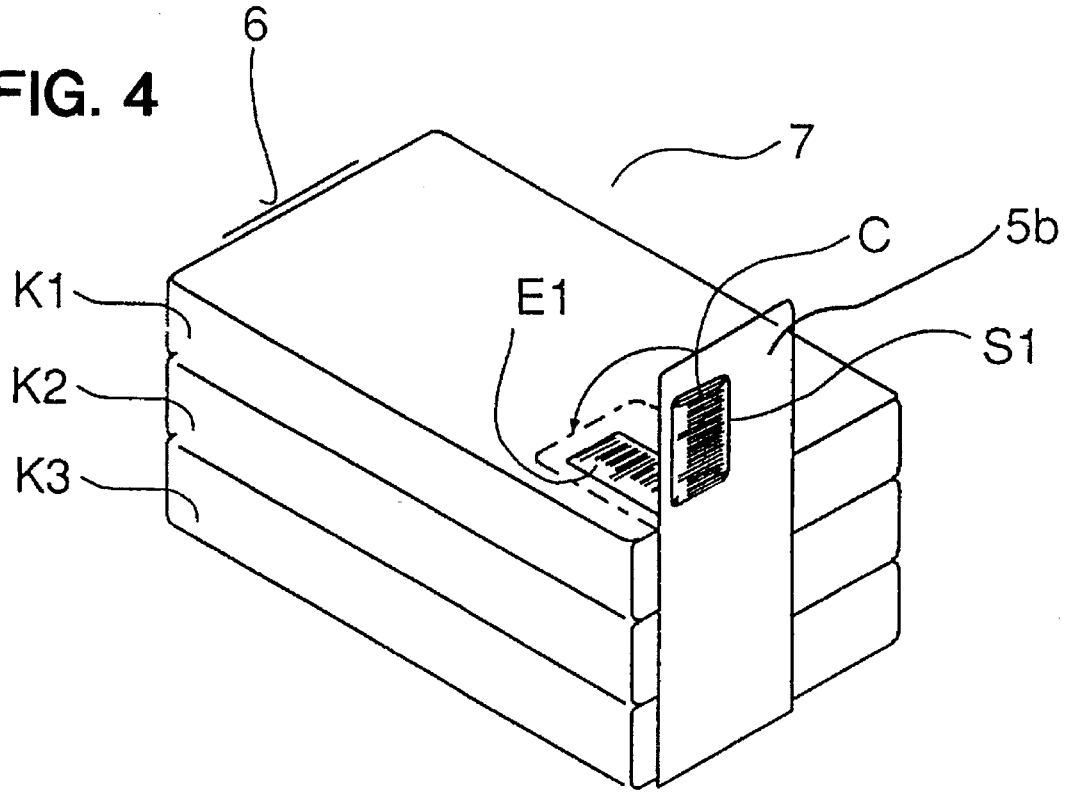
Figure 6:
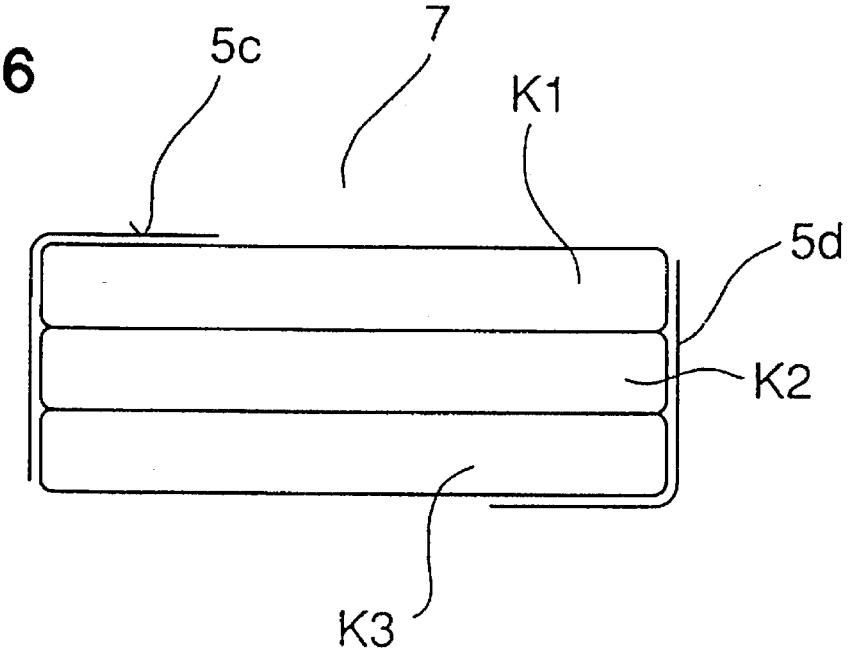

FIG. 3 shows a perspective view with an opaque adhesive strip with a pack marking and an individual marking on the upper article FIG. 4 shows a view according to FIG. 3 with a transparent adhesive strip with a pack marking (marking supplement) and an individual marking FIG. 5 shows variations of an adhesive strip with gripping aid FIG. 6 shows a variation according to FIG. 1A-1 with two L-shaped adhesive strips.

Figures 1, 1A, 2:
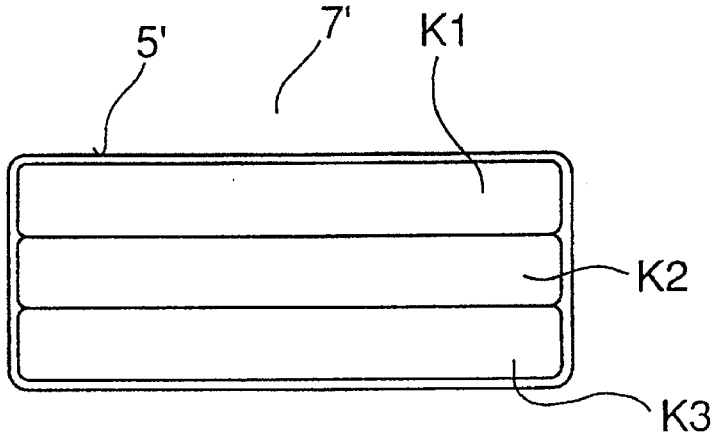

FIG. 2 shows a pack of 3 cuboidal articles, for example individual cassettes K1–K3 in boxes or in cases, comprising the L-shaped or U-shaped adhesive strip 5 and the planar adhesive strip 6, respectively provided on the narrow side of the stack 7.

Figure 1B:
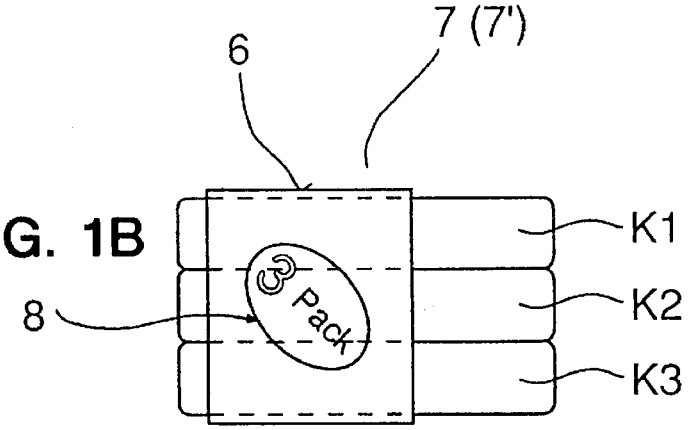
FIG. 1(B) shows a side view of FIG. 1A-1 or 1A-2 from the left
Figure 1C:
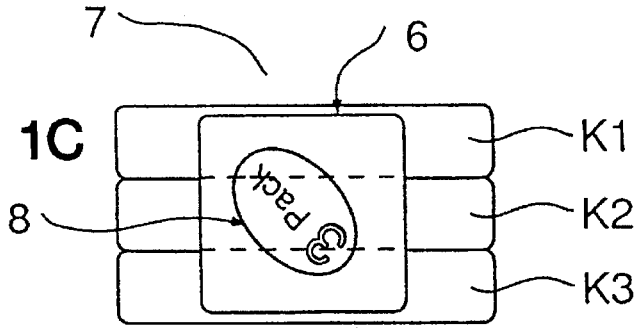
FIG. 1(C) shows a side view of FIG. 1A-1 from the right

FIG. 1A-1 shows a side view of the cassettes K1–K3 in the longitudinal direction, with a U-shaped adhesive strip 5 and a planar adhesive strip 6 located on the opposite narrow side. FIG. 1A-1 shows the same side view of a stack 7' of the cassettes K1–K3 with a single adhesive strip 5', which extends around the stack 7' in the longitudinal direction. Such an adhesive strip 5' may of course also be arranged around the stack 7' only in the transverse direction. In both cases, 2 U-shaped adhesive strips or 2 L-shaped adhesive strips may also be provided in each case, adequately overlapping each other. In an elevation or in the view from below (FIGS. 1B, 1C and 1E), on the U-shaped adhesive strip 5 there is provided a plain-text marking 8 "3 pack", which refers to the cassettes of 3 in number. In the plan view from above, on the adhesive strip 5 there is provided a bar-code marking 9 (for example in AEN code), which is machine-readable.

FIGS. 3 and 4 then show various configurations of such bar-code markings. In FIGS. 3 and 4, the individual marking E can be seen on the individual cassette K1 which is respectively on top.

Figure 1D:
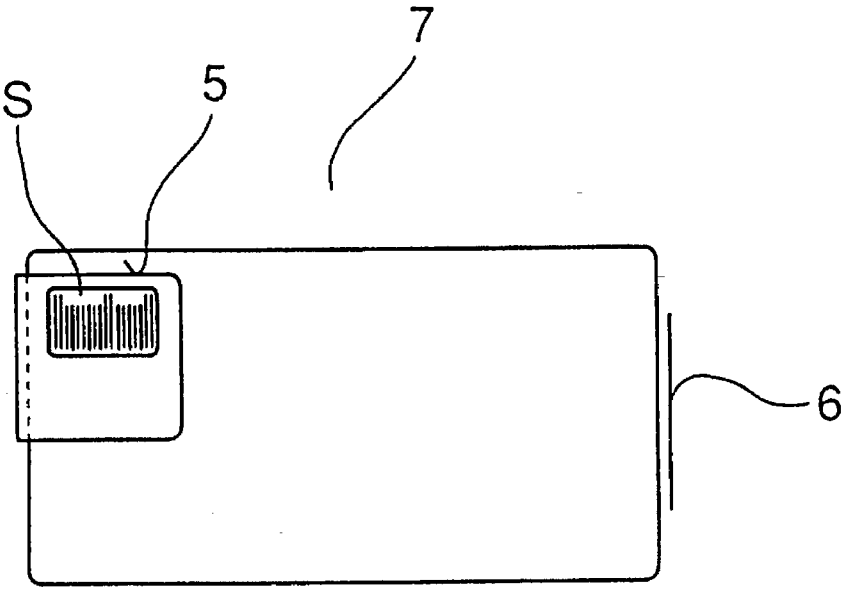
FIG. 1(D) shows a plan view of FIG. 1A-1
Figure 1E:
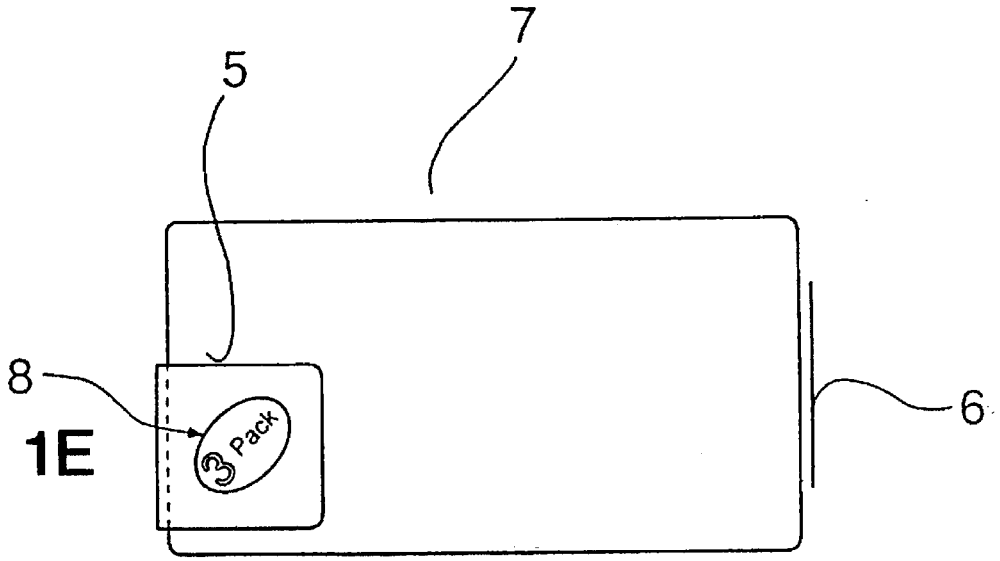
FIG. 1(E) shows a plan view of FIG. 1(A) from below
Figure 2:
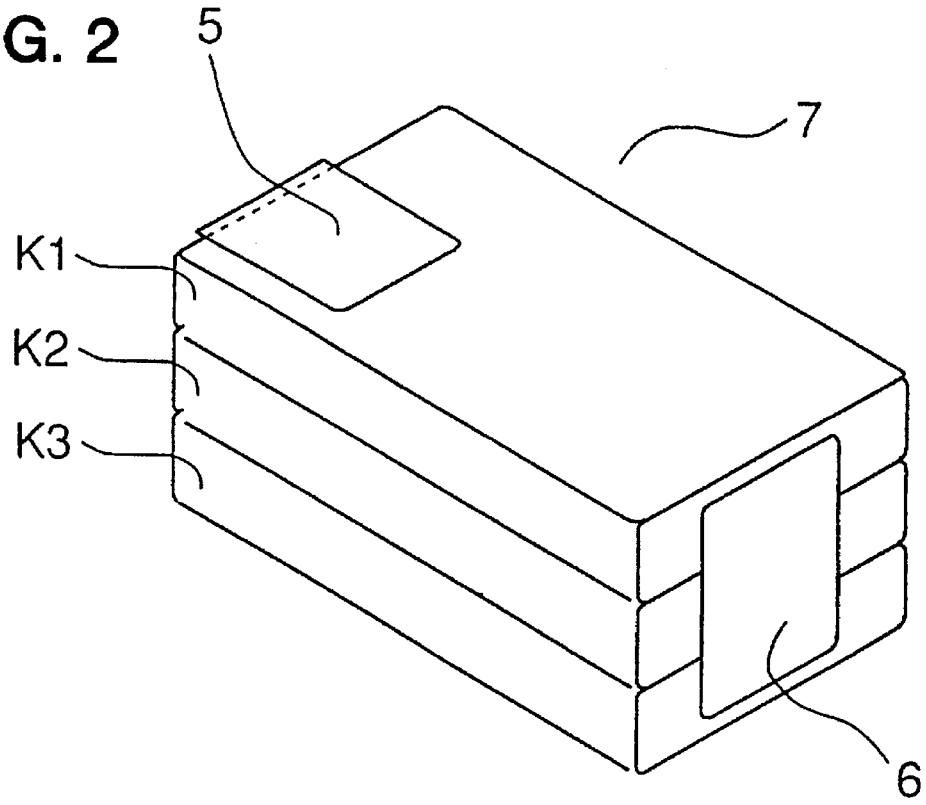

If the adhesive strip is opaque (adhesive strip **5*a*), the individual marking E is covered over its full area, ie. the individual marking E disappears under the multiple or collective marking S, as can be seen in FIG. 1D** in plan view.

FIG. 4 then shows a version in which the adhesive strip **5*b* is transparent. As readily evident, the multiple or collective marking S1** is provided with a supplementing or altering coding C, which either partially alters or supplements the individual marking coding E1, so that a code-reading machine then detects only the multiple or collective marking S1 and no longer the individual marking E1.

Figure 5A:
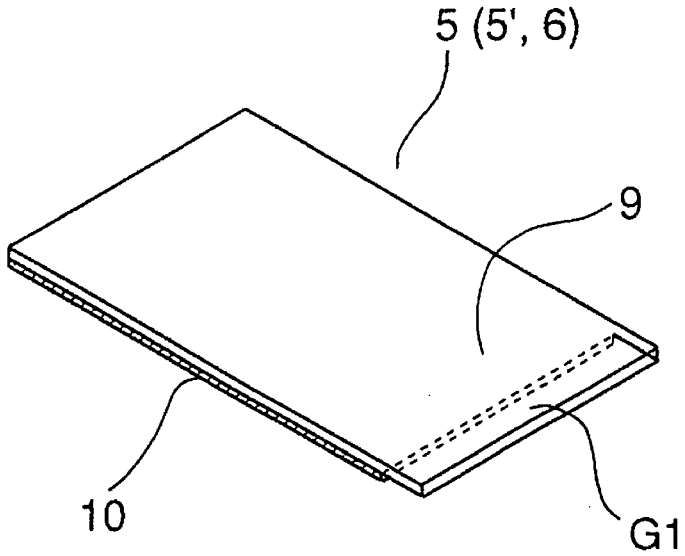

FIG. 5 shows a version of the adhesive strip (5, 5', 6). FIG. 5(A) may have a paper-laminate or plastics film as a substrate 9 with an adhesive layer 10, depending on how the individual packs are designed, as a cardboard case or as a film wrapping, for example of polyethylene or polypropylene. The film wrapping may also consist of heat-sealable polypropylene/polyethylene film.

It is also advantageously possible to produce the film wrapping and/or the adhesive strip from biodegradable material from the group consisting of caprolactone, cellulose acetate and polymeric starch derivatives or from homopolymers and copolymers of linear polyesters of 3-hydroxybutanoic acid and 3-hydroxyvaleric acid. These linear polyesters of butyrates or valerates, the latter consisting of 4 and 5 carbon atoms respectively, are readily degradable and can also be readily mixed with polyethylenes and polypropylenes.

An acrylic dispersion adhesive, which is transparent and ensures redetachability of the adhesive strip 5, 5', 6 has proved successful as the adhesive layer.

The material should substantially correspond to that of the respective individual packaging and both should be recyclable, together as far as possible.

The length and width of the adhesive strips 5, 5' and 6 are governed by the shape and the weight of the usually cuboidal articles. The length of the adhesive strips 5, 5' and 6 on the narrow side of the stack 7 or 7' should correspond approximately to the height of the stack 7 or 7', so that the uppermost and lowermost article is stuck over at least approximately half its height and secured better in the multipack. The length of overlap of the U-shaped and L-shaped parts of the adhesive strips 5, 5' may correspond approximately to one third of the overall length of the articles, it may also be less in the case of low weight and a smaller number of items in the stack. The width of the adhesive strips 5, 5' and 6 is expediently approximately half the article width, it may also be chosen to be wider or narrower, again depending on weight and number of items and also on the material of the adhesive strip 5, 5' and 6 of the respective adhesive layer, as well as on the adherence of the latter on the film material.

In FIG. 6 there is shown a version of the U-shaped adhesive strip 5 or 5' with a straight adhesive strip piece 6 in FIG. 1(A-1). In FIG. 6 both adhesive strips 5*c* and 5*d* have an L shape, so that in each case a diagonally opposite edge of the stack is enclosed. This version is the one which involves least outlay and has adequate strength of the stack in the drop test. However, it is also possible to combine a U-shaped adhesive strip 5 with an L-shaped adhesive strip 5*c*, 5*d* or two adhesive strips 5 in U shape, also in the configuration of adhesive strip 5'.

Figure 5B:
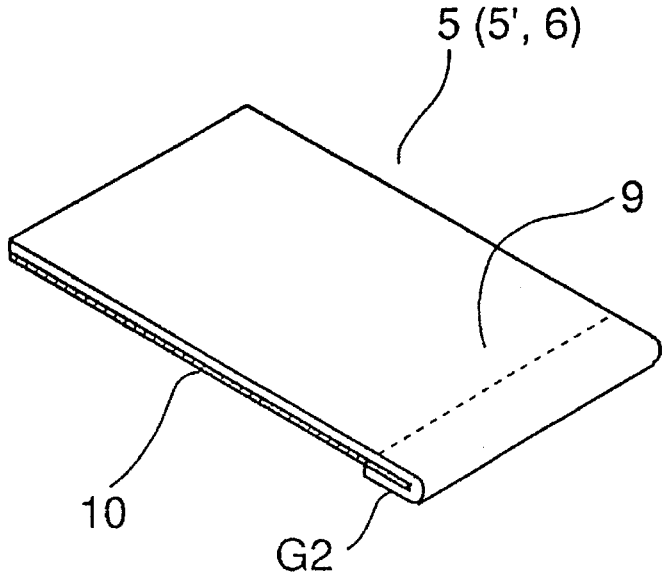
Figure 5C:
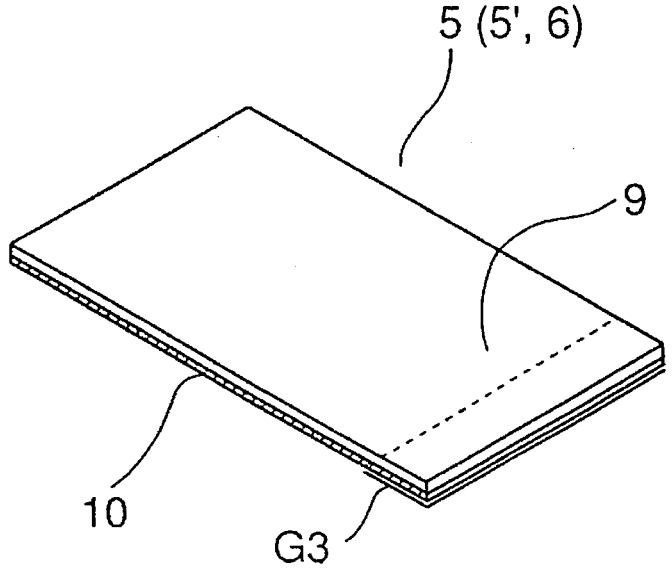

In FIGS. 5(A)–5(C) there are provided end regions G1 to G3, which are of various designs.

In FIG. 5(A), the adhesive layer 10 is shorter than the length of the substrate 9, so that there remains a strip G1 which can be grasped by hand. In FIG. 5(B), the adhesive layer 10 is in turn shorter than the length of the substrate 9; but the end G2 is adhesively attached as a turned-over edge to the adhesive layer 10.

Finally, in the case of FIG. 5(C), the region G3 is formed by an additional covering of an adhesive-layer strip, it being possible for the covering to be a coating layer, printed layer etc.

The adhesive strips are to be designed with respect to their adhesive layer in such a way that they can be detached again from their underlay, by hand and as far as possible without any separating implement, such as for example a knife.

In all cases, the gripping aid (G1–G3) provides a good possibility of grasping the end of the adhesive strip by hand and pulling off the same non-destructively, after which the articles or cassettes are individually separated.

A pack for stacked articles with at least an identical base area, for example rectangular or square, substantially comprises at least one adhesive strip which does not have lines of weakness or tearing lines and is preferably provided on the narrow sides of the stack. The material is expediently recyclable and corresponds as far as possible to the other packaging material. A gripping aid facilitates the largely non-destructive pulling off of the adhesive strips for individually separating the articles. The pack can be used for all rectangularly shaped articles such as cuboids, cubes, disks etc., such as for example magnetic tape cassettes or disks, optical recording media, boxes with articles, etc.

We claim:

1. An article pack comprising articles arranged in a stack with opposite side faces of each article together defining opposite side faces of the stack, each article having a base area of the same rectangular shape and having an individual marking and positioned so that at least one individual marking is on the outside of the stack, and at least one adhesive strip joining the article side faces on each side of the stack and having no lines of weakness in a region where the strip bridges across adjacent articles in the stack, the at least one adhesive strip covering the at least one individual marking on the outside of the stack and having a collective marking of its own representative of the pack contents which is different from the at least one individual marking covered by the at least one adhesive strip.

2. An article pack as defined in claim 1, which comprises at least two adhesive strips.

3. An article pack as defined in claim 1, wherein the at least one adhesive strip is opaque and has a collective marking thereon.

4. An article pack as defined in claim 1, wherein the at least one adhesive strip is transparent and has a collective marking thereon, altering the at least one individual marking covered by the at least one adhesive strip.

5. An article pack as claimed in claim 1, wherein the adhesive strip consists of paper material.

6. An article pack as defined in claim 1, wherein the at least one adhesive strip comprises a recyclable plastics material.

7. An article pack according to claim 1, wherein each article has an individual wrapping of a plastics film material, and wherein the at least one adhesive strip comprises a material jointly recyclable with the plastics film material.

8. An article pack as claimed in claim 7, wherein the at least one adhesive strip consists of a polyolefin material.

9. An article pack as defined in claim 7, wherein the at least one adhesive strip comprises a material from the group consisting of caprolactone, cellulose acetate and polymeric starch derivative.

10. An article pack as defined in claim 7, wherein the at least one adhesive strip comprises a material from the group consisting of homopolymers and copolymers of linear polyesters of 3-hydroxybutanoic acid and 3-hydroxyvaleric acid.

11. An article pack as defined in claim 1, wherein the at least one adhesive strip has an L shape and joins one side face and one of the upper or lower faces of the stack to one another.

12. An article pack as defined in claim 1, wherein the at least one adhesive strip has a U shape and joins at least one side face and the upper and lower faces of the stack to one another.

13. An article pack as defined in claim 1, wherein the at least one adhesive strip has at least one end which is designed as a gripping aid.

14. An article pack as defined in claim 13, wherein the end which is designated as a gripping aid is designed as an adhesive-free region.

15. An article pack as defined in claim 1, in which the articles comprise magnetic-tape cassettes.

16. An article pack as defined in claim 1, in which the articles comprise compact disks in boxes.

* * * * *